US011626063B2

(12) United States Patent
Kang

(10) Patent No.: US 11,626,063 B2
(45) Date of Patent: Apr. 11, 2023

(54) DRIVE UNIT FOR DISPLAY DEVICE

(71) Applicant: LG Display Co., Ltd., Seoul (KR)

(72) Inventor: Jeongho Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/578,021

(22) Filed: Jan. 18, 2022

(65) Prior Publication Data

US 2022/0139306 A1 May 5, 2022

Related U.S. Application Data

(62) Division of application No. 17/119,727, filed on Dec. 11, 2020, now Pat. No. 11,263,961.

(30) Foreign Application Priority Data

Dec. 26, 2019 (KR) ..... 10-2019-0175673

(51) Int. Cl.
*G09G 3/32* (2016.01)
*G09G 3/3275* (2016.01)

(52) U.S. Cl.
CPC ..... *G09G 3/32* (2013.01); *G09G 3/3275* (2013.01); *G09G 2310/0264* (2013.01); *G09G 2310/0291* (2013.01); *G09G 2320/0209* (2013.01); *G09G 2330/028* (2013.01)

(58) Field of Classification Search
CPC ..... G09G 3/3275; G09G 2310/0291; G09G 2320/0209; G09G 2330/028
See application file for complete search history.

(56) References Cited

U.S. PATENT DOCUMENTS

2008/0106316 A1 5/2008 Ha
2012/0169783 A1 7/2012 Park
2016/0042687 A1 2/2016 Jeong et al.
2020/0286448 A1 9/2020 Kim et al.
2020/0394966 A1 12/2020 Lim et al.

FOREIGN PATENT DOCUMENTS

KR 10-2018-0002390 A 1/2018

OTHER PUBLICATIONS

Intellectual Property Office of the United Kingdom, Office Action, GB Patent Application No. 2020352. 7, dated Jun. 2, 2021, four pages.

*Primary Examiner* — Gene W Lee
(74) *Attorney, Agent, or Firm* — Fenwick & West LLP

(57) ABSTRACT

The present disclosure relates to a driver for a display device. A driver for a display device according to an embodiment is characterized in generating a voltage supplied as a bias voltage of a source buffer of a data driver in conjunction with a voltage supplied to a display panel. Therefore, the driver for the display device according to the present disclosure has an advantage that the headroom margin of the source buffer can be secured and power consumption of the driver is low at the same time, even when an image data pattern causing a variation in the voltage is input to the display device.

4 Claims, 11 Drawing Sheets

DRIVE UNIT FOR DISPLAY DEVICE

CROSS-REFERENCE TO RELATED APPLICATION

This application is a divisional of U.S. patent application Ser. No. 17/119,727 filed on Dec. 11, 2020 which claims the priority benefit of Republic of Korea Patent Application No. 10-2019-0175673 filed on Dec. 26, 2019, each of which is incorporated by reference in its entirety.

BACKGROUND

Field of the Disclosure

The present disclosure relates generally to a driver for a display device and, more particularly, to a driver for a display device that generates a voltage supplied as a bias voltage of a source buffer of a data driver in conjunction with a voltage supplied to a display panel.

Description of the Background

Recently, a display device is frequently used due to characteristics of excellent image quality, light weight, thinness, and low power. The display device includes a liquid crystal display, an organic light emitting diode display, and the like, and most of them are commercially available.

The display device includes a display panel in which a plurality of pixels is arranged in the form of a matrix, a gate driver driving gate lines of the display panel, a data driver driving data lines of the display panel, and the like.

The gate driver sequentially drives the gate lines of the display panel.

The data driver converts a digital data signal into an analog data signal whenever the gate lines are driven and supplies the resulting signal to the display panel.

When a transition of image data, which is input to the display device, is large, poor image quality, such as cross-talk, may occur.

The above-described background technology is technical information acquired by the inventor for the derivation of the present disclosure or acquired in the derivation process of the present disclosure, and is not necessarily a known technology disclosed to the general public prior to the filing of the present disclosure.

SUMMARY

An objective of the present disclosure is to provide a driver for a display device that generates a voltage supplied as a bias voltage of a source buffer of a data driver in conjunction with a voltage supplied to a display panel.

As a means for solving the above-described objective, the present disclosure has an embodiment with the following features.

A driver for a display device according to an embodiment includes a data driver including a source buffer that outputs a data voltage to a data line of a display panel of the display device; and a power supply unit supplying a first voltage to a power line of the display panel and a second voltage to the data driver, wherein the power supply unit includes a first voltage generator generating the first voltage; and a second voltage generator generating the second voltage based on the first voltage, in which the second voltage is supplied as a bias voltage of the source buffer.

The second voltage generator may multiply the first voltage by a predetermined number to generate the second voltage.

The second voltage generator may increase the first voltage by a predetermined voltage to generate the second voltage.

The second voltage generator may include an operational amplifier (also referred to as "OP amplifier" herein), a first resistor, and a second resistor, in which the first voltage is applied to a first input terminal of the OP amplifier; a second input terminal of the OP amplifier is connected to one end of the first resistor and one end of the second resistor; other end of the first resistor is grounded; and other end of the second resistor is connected to an output terminal of the OP amplifier.

At least one of the first resistor and the second resistor may be a variable resistor.

The power supply unit may further include a controller for adjusting the variable resistor.

A driver for a display device according to an embodiment includes a data driver including a source buffer that outputs a data voltage to a data line of a display panel of the display device; and a power supply unit supplying a first voltage to a power line of the display panel and supplying one selected from a second voltage and a third voltage to the data driver, wherein the power supply unit includes: a first voltage generator generating the first voltage and the second voltage; and a second voltage generator generating the third voltage based on the first voltage, in which the one selected from the second voltage and the third voltage is supplied as a bias voltage of the source buffer.

The second voltage generator may multiply the first voltage by a predetermined number to generate the third voltage.

The second voltage generator may increase the first voltage by a predetermined voltage to generate the third voltage.

The power supply unit may further include a multiplexer (MUX) circuit for selecting one of the second voltage and the third voltage.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
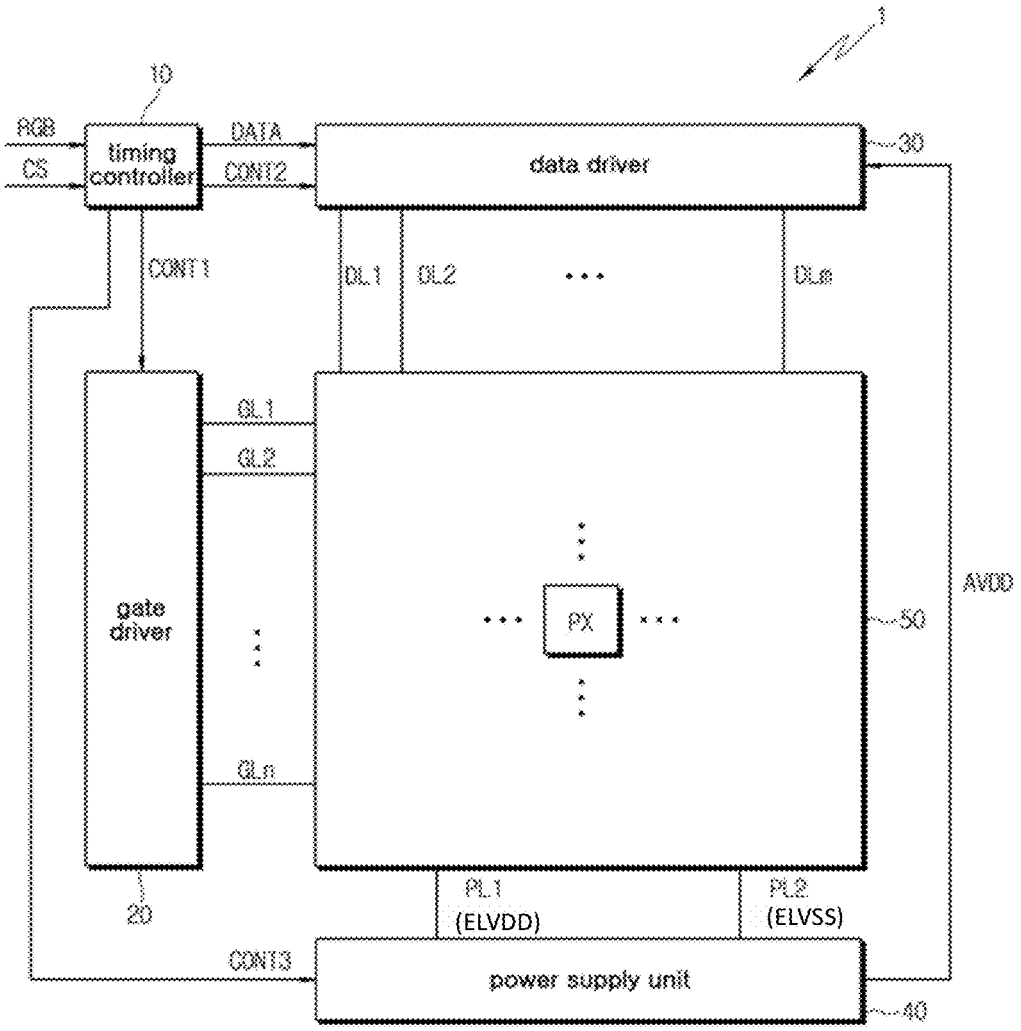
FIG. 1 is a block diagram illustrating a configuration of a display device according to an embodiment of the present disclosure.

Hereinafter, embodiments according to the present disclosure will be described with reference to the accompanying drawings. In this specification, when a component (or region, layer, part, etc.) is referred to as being "on", "connected" to, or "joined" to another component, it means that the component may be directly connected/coupled to another component or the component can be connected/coupled to another component with a third component in between.

The same reference numbers refer to the same components. In addition, in the drawings, the thickness, ratio, and dimensions of the components are exaggerated for effective description of technical content. Terms "and/or" include one or more combinations capable of being defined by associated configurations.

Terms such as "first" and "second" may be used to describe various components, but the components are not limited by the terms. The terms are used only for the purpose of distinguishing one component from other components. For example, the first component may be referred to as a second component without departing from the scope of rights of various embodiments, and similarly, the second component may also be referred to as a first component. Singular expressions include plural expressions unless the context clearly indicates otherwise.

The terms such as "below", "lower", "above", "upper", etc. are used to describe the association of the components shown in the drawings. The terms are relative concepts and are explained on the basis of the directions indicated in the drawings.

It should be understood that terms such as "comprise" or "have" is intended to designate the presence of features, numbers, steps, operations, components, parts or combinations thereof described in the specification, but not to exclude the possibility of the presence or addition of one or more other features or numbers, steps, operations, components, parts, or combinations thereof.

FIG. 1 is a block diagram illustrating a configuration of a display device according to an embodiment of the present disclosure.

Referring to FIG. 1, the display device 1 may include a timing controller 10, a gate driver 20, a data driver 30, a power supply unit 40, and a display panel 50.

The timing controller 10 may receive an image signal RGB and a control signal CS from the outside. The image signal RGB may include a plurality of pieces of gradation data. The control signal CS may include, for example, a horizontal synchronization signal, a vertical synchronization signal, and a main clock signal.

The timing controller 10 processes the image signal RGB and the control signal CS in such a manner as to be suitable for operating conditions of the display panel 50, to generate and output an image data DATA, a gate driving control signal CONT1, a data driving control signal CONT2, and a power supply control signal CONT3.

The gate driver 20 may be connected to pixels PXs of the display panel 50 through a plurality of gate lines GL1 to GLn. The gate driver 20 may generate gate signals on the basis of the gate driving control signal CONT1 output from the timing controller 10. The gate driver 20 may provide the generated gate signals to the pixels PX through the plurality of gate lines GL1 to GLn.

The data driver 30 may be connected to the pixels PXs of the display panel 50 through a plurality of data lines DL1 to DLm. The data driver 30 may generate data signals on the basis of the image data DATA and the data driving control signal CONT2 output from the timing controller 10. The data driver 30 may provide the generated data signals to the pixels PXs through the plurality of data lines DL1 to DLm.

The power supply unit 40 may be connected to the pixels PXs of the display panel 50 through a plurality of power lines PL1 and PL2. The power supply unit 40 may generate a voltage to be provided to the display panel 50 and the panel driver on the basis of the power supply control signal CONT3. The power supply unit 40 may generate, for example, a first voltage ELVDD and a second voltage AVDD. The power supply unit 40 may provide the generated first voltage ELVDD to the pixels PXs through the corresponding power lines PL1 and PL2. The power supply unit 40 may provide the second voltage AVDD to the data driver 30.

A plurality of pixels PXs (or referred to as sub-pixels) is disposed on the display panel 50. The pixels PX may be arranged in the form of a matrix on the display panel 50, for example.

Each pixel PX may be electrically connected to a corresponding gate line and data line. The pixels PX may emit light with luminance corresponding to the gate signals and the data signals supplied through the gate lines GL1 to GLn and the data lines DL1 to DLm.

Each pixel PX may display any one of the first to third colors. In one embodiment, each pixel PX may display any one of red, green, and blue colors. In another embodiment, each pixel PX may display any one of cyan, magenta, and yellow colors. In various embodiments, the pixels PXs may be configured to display any one of four or more colors. For example, each pixel PX may display any one of red, green, blue, and white colors.

The timing controller 10, the gate driver 20, the data driver 30, and the power supply unit 40 may be each formed in a separate integrated circuit (IC), or at least a part of the timing controller 10, the gate driver 20, the data driver 30, and the power supply unit 40 may be formed in an integrated circuit. For example, at least one of the data driver 30 and the power supply unit 40 may be composed of an integrated circuit combined with the timing controller 10.

In addition, in FIG. 1, the gate driver 20 and the data driver 30 are shown as separate components from the display panel 50, but at least one of the gate driver 20 and the data driver 30 may be integrally formed with the display panel 50 by in-panel method. For example, the gate driver 20 may be integrally formed with the display panel 50 according to a gate in panel (GIP) method.

Figure 2:
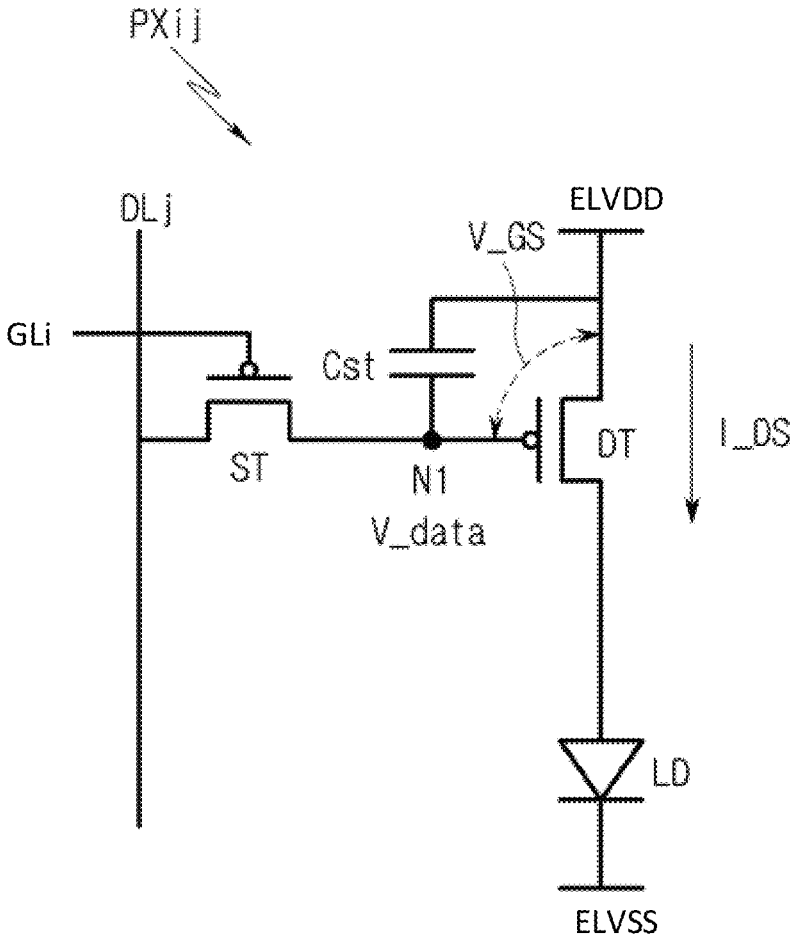
FIG. 2 is a circuit diagram illustrating an embodiment of a pixel illustrated in FIG. 1.

FIG. 2 is a circuit diagram illustrating an embodiment of the pixel illustrated in FIG. 1. FIG. 2 illustrates an example of a pixel PXij connected to the i-th gate line GLi and the j-th data line DLj.

Referring to FIG. 2, the pixel PX includes a switching transistor ST, a driving transistor DT, a storage capacitor Cst, and a light emitting element LD.

A first electrode (e.g., source electrode) of the switching transistor ST is electrically connected to the j-th data line DLj, and a second electrode (e.g., drain electrode) is electrically connected to a first node N1. A gate electrode of the switching transistor ST is electrically connected to the i-th gate line GLi. When a gate signal of a gate-on level is applied to the i-th gate line GLi, the switching transistor ST is turned on to transmit a data signal V_data applied to the j-th data line DLj to the first node N1.

The storage capacitor Cst is configured to have a first electrode electrically connected to the first node N1, and a second electrode receiving the first voltage ELVDD. The storage capacitor Cst may charge a voltage corresponding to a difference between the voltage applied to the first node N1 and the first voltage ELVDD.

The driving transistor DT is configured to have a first electrode (e.g., source electrode) receiving the first voltage ELVDD, and a second electrode (e.g., drain electrode) electrically connected to a first electrode (e.g., anode electrode) of the light emitting element LD. The gate electrode of the driving transistor DT is electrically connected to the first node N1. When a voltage of the gate-on level is applied through the first node N1, the driving transistor DT is turned on to control an amount of driving current I_DS flowing through the light emitting element LD in correspondence with the voltage provided to the gate electrode.

The amount of driving current I_DS flowing through the light emitting element LD is as shown in Equation 1 below.

$$I_{DS}=K(V_{GS}-V_{TH})^2 \quad \text{[Equation 1]}$$

That is, the amount of driving current LDS flowing through the light emitting element LD is controlled according to a magnitude of a voltage V_GS, which is a difference between the first voltage ELVDD of the first electrode (for example, source electrode) and the voltage V_data provided to the gate electrode in the driving transistor DT.

The light emitting element LD outputs light corresponding to the driving current. The light emitting element LD may output light corresponding to any one of red, green, and blue colors. The light emitting element LD may be an organic light emitting diode OLED, or an ultra-small inorganic light emitting diode having a size ranging from micro to nanoscale, but the present disclosure is not limited thereto. Hereinafter, the technical idea of the present disclosure will be described with reference to an embodiment in which the light emitting element LD is composed of an organic light emitting diode.

In the present disclosure, the structure of the pixel PX is not limited to that shown in FIG. 2. According to an embodiment, the pixel PX may further include at least one element for compensating a threshold voltage of the driving transistor DT or for initializing a voltage of a gate electrode of the driving transistor DT and/or a voltage of an anode electrode of the light emitting element LD.

Although an example in which the switching transistor ST and the driving transistor DT are NMOS transistors is shown in FIG. 2, the present disclosure is not limited thereto. For example, at least some or all of transistors constituting each pixel PX may be configured as PMOS transistors. In various embodiments, each of the switching transistor ST and the driving transistor DT may be implemented as a low temperature polysilicon (LTPS) thin film transistor, an oxide thin film transistor, or a low temperature polycrystalline oxide (LTPO) thin film transistor.

Figure 3:
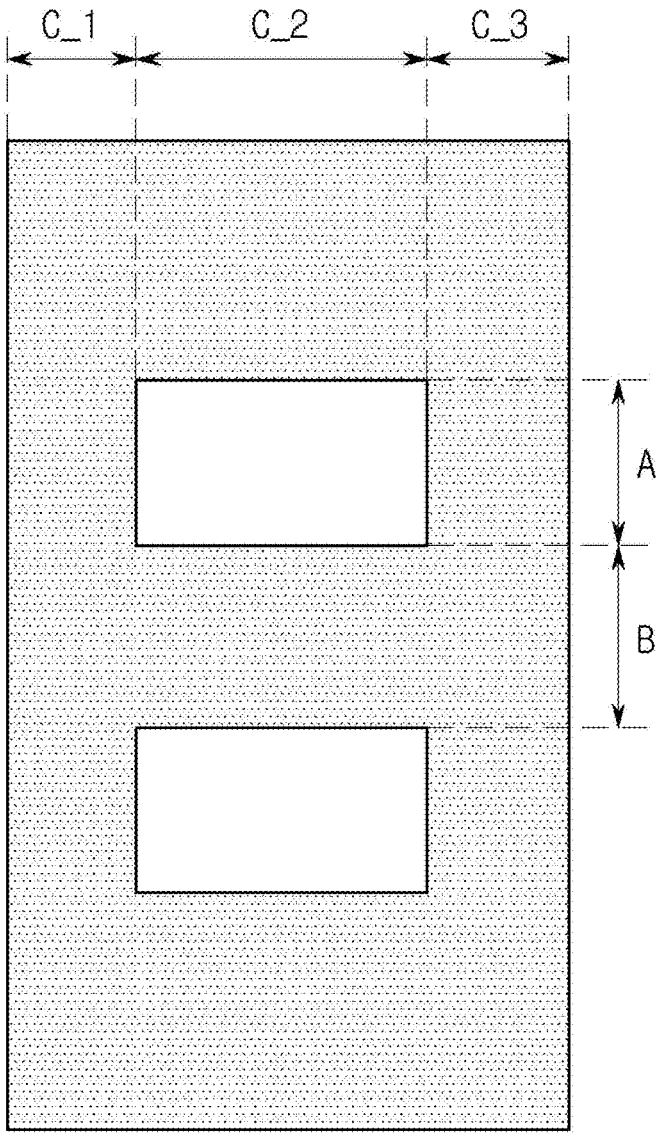
FIG. 3 is a view illustrating an embodiment of a display panel displaying an input box pattern.

FIG. 3 is a view illustrating an embodiment of a display panel displaying an input box pattern.

FIG. 3 shows an image of one frame displayed on the display panel. All of image data input to regions C_1 and C_3 have a black image data value, and have no data transition. However, image data input to a region C_2 changes from black to white images in a region A, and changes back from white to black images in a region B. When a transition of the image data is large as in the region C_2, a variation of the first voltage ELVDD applied from the power supply unit 40 to the power line of the display panel 50 may be large.

When a white image is displayed on the pixel PX included in the display panel 50, the driving current I_DS of the driving transistor DT constituting the pixel PX increases, so that a voltage drop (IR-DROP) occurs largely due to a resistance component of the power line to which the first voltage ELVDD is applied. As a result, the first voltage ELVDD drops.

Conversely, when a black image is displayed in the pixel PX included in the display panel 50, the driving current I_DS of the driving transistor DT constituting the pixel PX decreases, so that a voltage drop (IR-DROP) becomes small due to a resistance component of the power line to which the first voltage ELVDD is applied. As a result, the first voltage ELVDD is higher than an average voltage level of the first voltage ELVDD.

When the transition of the input image data is large as described above, the first voltage ELVDD supplied from the power supply unit 40 to the display panel 50 is not a constant voltage, but is varied.

The variation of the first voltage ELVDD causes a deviation in the driving current I_DS of the driving transistor DT for each pixel PX, which results in a difference in luminance of the pixel PX. The difference in luminance for each pixel PX causes poor image quality of the display device.

As a method of solving such poor image quality, there is a technique of generating a gamma voltage V-Gamma compensated by the variation of the first voltage (ELVDD) in a driver (specifically, a data driver). However, the method of compensating the gamma voltage V-Gamma causes another problem that a headroom margin HR of the source buffer included in the data driver is reduced to prevent the output of the source buffer from reaching a normal level.

Figure 4:
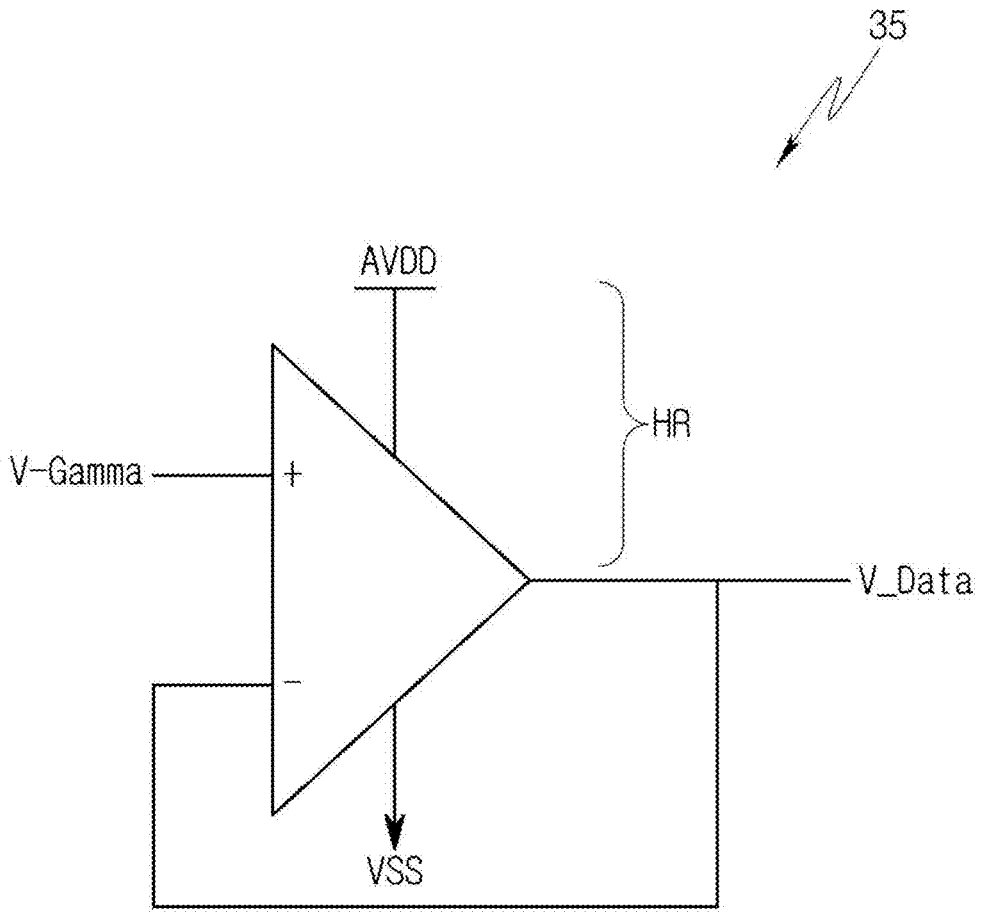
FIG. 4 is a circuit diagram illustrating a source buffer included in a data driver.

FIG. 4 is a circuit diagram illustrating a source buffer included in a data driver.

Figure 5:
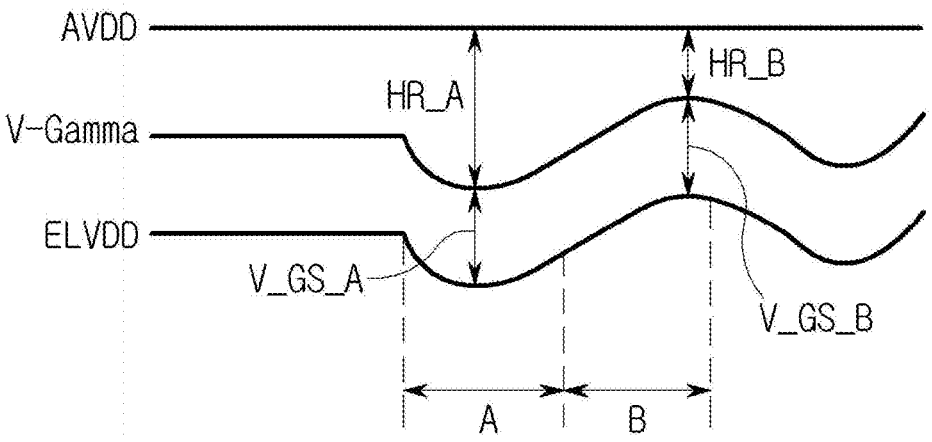
FIG. 5 is a view illustrating that a headroom margin HR of a source buffer is deficient due to a variation of a first voltage.

FIG. 5 is a view illustrating that a headroom margin HR of a source buffer is deficient due to a variation of a first voltage.

Figure 6A:
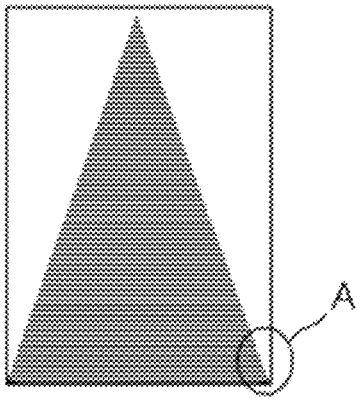
FIGS. 6A and 6B are views illustrating that poor image quality occurs due to a deficiency of a headroom margin HR of a source buffer.
Figure 6B:
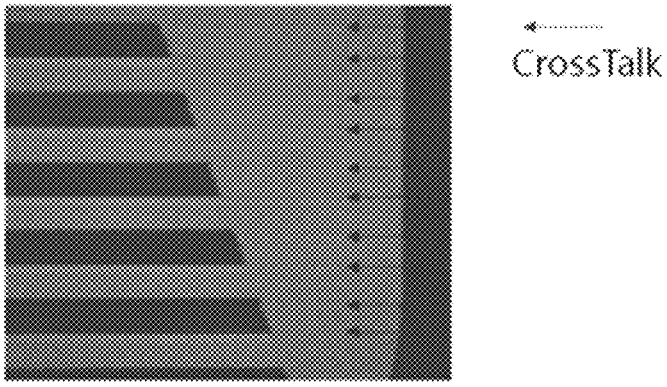

FIGS. 6A and 6B are views illustrating that poor image quality occurs due to a deficiency of a headroom margin HR of a source buffer.

Referring to FIGS. 4 to 6, a problem that an output of the source buffer does not reach a normal level will be described.

The data driver 30 drives data lines of the display panel 50 on the basis of digital image data DATA output from the timing controller 10 under the control of the timing controller 10. The data driving circuit includes a shift register, a latch unit, a digital-to-analog converter, and a source buffer unit.

Here, the digital-to-analog converter generates analog voltages corresponding to the digital image data. The source buffer unit buffers analog voltages output from the digital-to-analog converter, and outputs analog voltages corresponding to the buffering result to the data lines. The source buffer unit includes a plurality of source buffers 35, and each source buffer 35 buffers the corresponding analog voltage output from the digital-to-analog converter and outputs the buffered analog voltage V_data to the corresponding data line.

Herein, the source buffer 35 is supplied with a bias voltage for driving the source buffer 35. The bias voltage may be a second voltage AVDD supplied from the power supply unit. The source buffer 35 includes an OP amplifier with a voltage gain of 1, and the OP amplifier has a positive (+) terminal receiving a gamma voltage V-Gamma signal, a negative (−) terminal connected to an output of the OP amplifier, and an output terminal outputting the voltage signal V_data. In addition, the source buffer 35 includes an OP amplifier, and each OP amplifier may transmit a voltage signal V_data to one data line DL.

Each OP amplifier constituting the source buffer 35 should secure a voltage margin called headroom, in order to prevent saturation of a transistor constituting the OP amplifier. When a proper headroom margin is not secured, the voltage V_data output from the source buffer 35 does not reach a normal level.

In FIG. 5, the first voltage ELVDD decreases in a section A and rises in a section B. The variation of the first voltage ELVDD may occur in an image in which the transition of image data is large, as shown in FIG. 3. As described above, the variation of the first voltage ELVDD causes a luminance difference between pixels PXs constituting the display panel, which results in poor image quality. As a method for solving this problem, the technique for generating a gamma voltage V-Gamma compensated by the variation of the first voltage (ELVDD) has been described. As illustrated in FIG. 5, the gamma voltage V-Gamma is compensated by the variation of the first voltage ELVDD, and thus decreases in the section A and rises in the section B, like the first voltage ELVDD. Accordingly, the voltage V_GS, which is a difference value between the first voltage ELVDD and the gamma voltage V-Gamma, has a constant value in all sections including the section A and the section B. As a result, a difference in luminance due to a difference in V_GS between the pixels PXs is prevented.

However, the second voltage AVDD supplied as a bias voltage of the source buffer 35 has a fixed value. In general, the second voltage AVDD is supplied as a DC voltage from the power supply unit 40 through a DC-DC converter. Since the second voltage AVDD is a fixed DC voltage, there is no problem in securing the headroom margin HR in the section A, but a problem in which proper headroom margin is not secured occurs in the section B where the first voltage ELVDD and the gamma voltage V-Gamma are reduced. Therefore, in the section B, the voltage V_data output from the source buffer 35 does not reach a normal level.

As a result, as shown in FIGS. 6A and 6B, an image with a large transition of input image data is not normally displayed on the display device, and a poor image quality such as crosstalk occurs.

Embodiment 1

Figure 7:
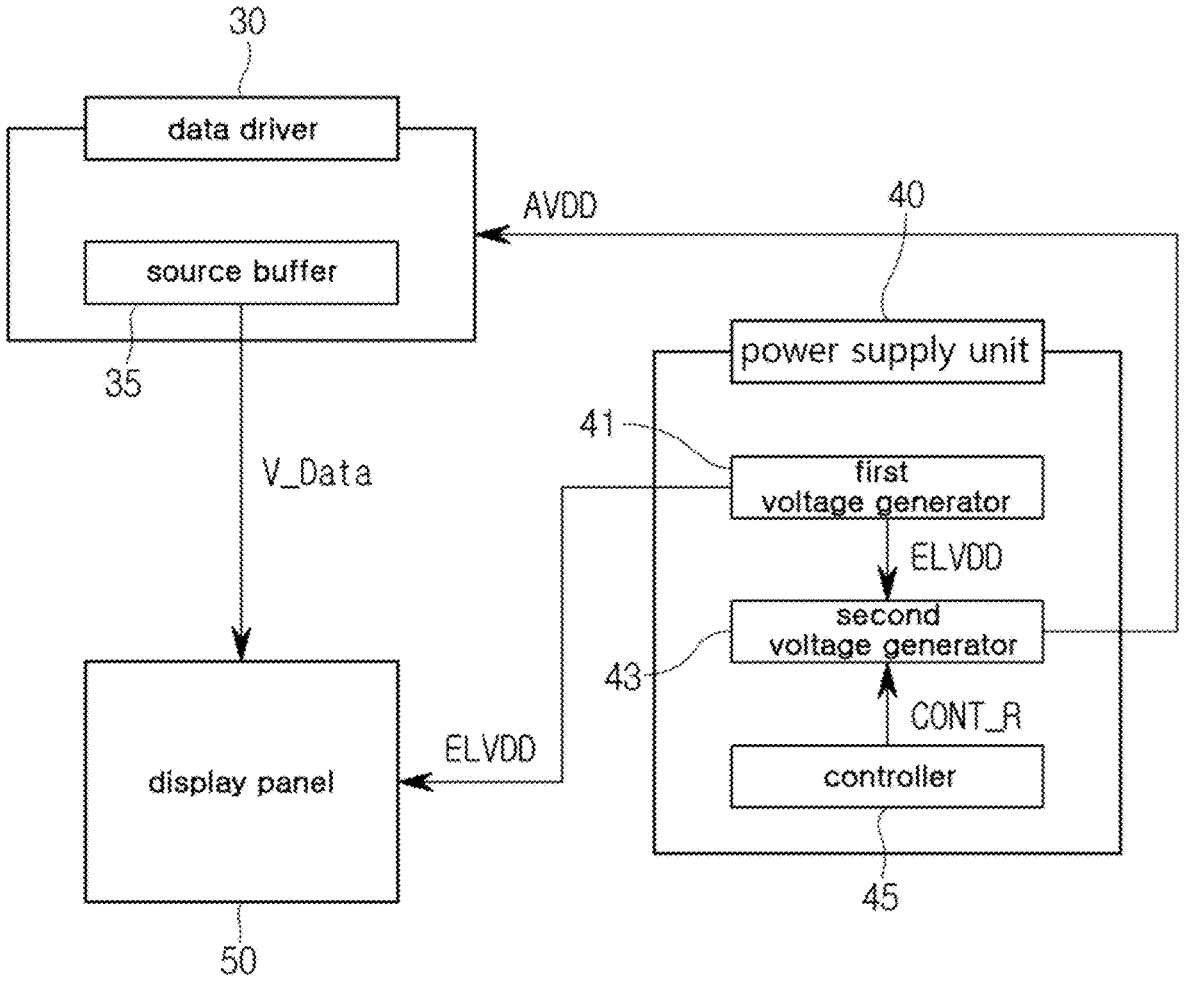
FIG. 7 is a block diagram illustrating a driver for a display device according to a first embodiment of the present disclosure.

FIG. 7 is a block diagram illustrating a driver for a display device according to a first embodiment of the present disclosure.

Figure 8:
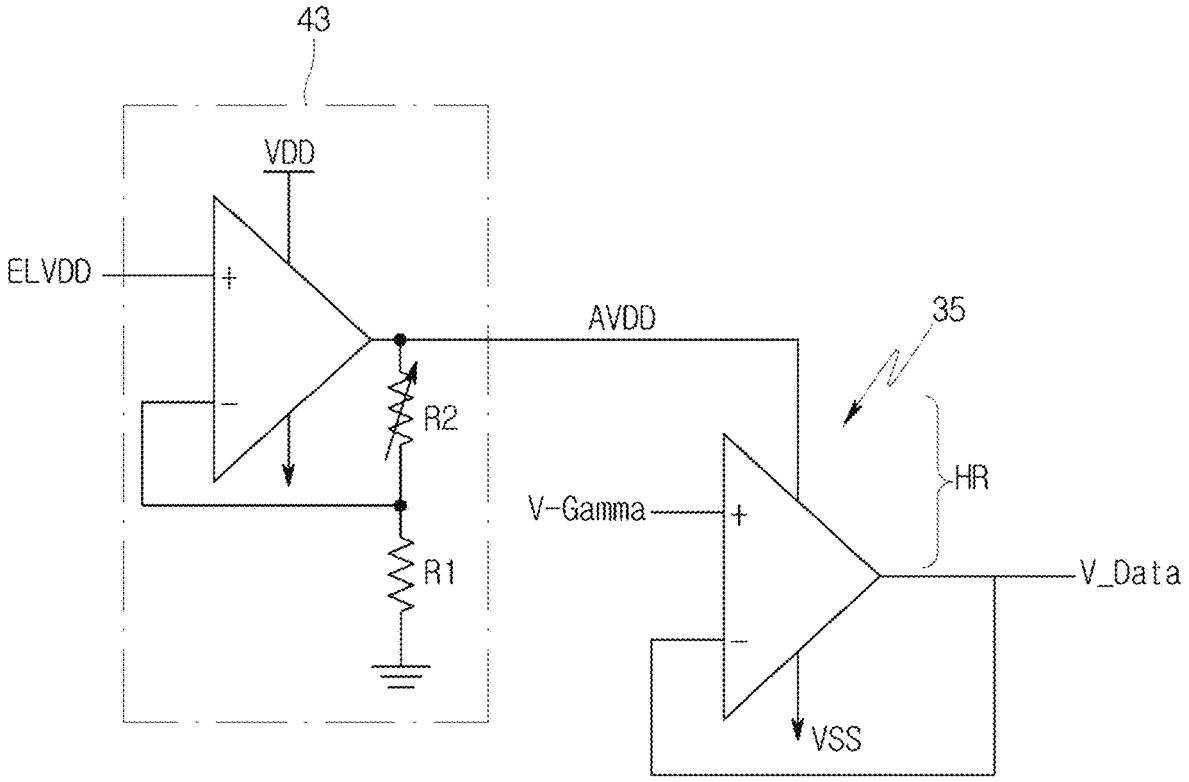
FIG. 8 is a main circuit diagram illustrating a driver for a display device according to a first embodiment of the present disclosure.

FIG. 8 is a main circuit diagram illustrating a driver for a display device according to a first embodiment of the present disclosure.

A driver for a display device according to an embodiment of the present disclosure includes a data driver 30 including a source buffer 35 for outputting a data voltage V_data to a data line of a display panel 50, and a power supply unit 40 that supplies a first voltage ELVDD to a power line of the display panel 50 and supplies a second voltage AVDD to the data driver 30.

The power supply unit 40 includes a first voltage generator 41, a second voltage generator 43, and a controller 45.

The first voltage generator 41 generates the first voltage ELVDD to be supplied to a power line of the display panel 50.

The second voltage generator 43 generates the second voltage AVDD on the basis of the first voltage ELVDD, and supplies the second voltage AVDD as a bias voltage of the source buffer 35.

The controller 45 outputs a control signal CONT_R to the second voltage generator 43 to adjust the second voltage AVDD generated by the second voltage generator 43.

The second voltage generator 43 may multiply the first voltage ELVDD by a predetermined number K to generate the second voltage AVDD. In addition, the second voltage generator 43 may increase the first voltage ELVDD by a predetermined voltage to generate the second voltage AVDD.

The second voltage generator 43 may be configured with a non-inverting amplification circuit including an OP amplifier. The second voltage generator 43 includes an OP amplifier, a first resistor R1, and a second resistor R2. Although the second resistor R2 is composed of a variable resistor in FIG. 8, the first resistor R1 may be composed of a variable resistor, or both the first resistor R1 and the second resistor R2 may be composed of variable resistors.

The first voltage ELVDD is input to a first input terminal (+ terminal) of the OP amplifier.

The second input terminal (− terminal) of the OP amplifier is connected to one end of the first resistor R1 and one end of the second resistor R2.

Further, the other end of the first resistor R1 is grounded, and the other end of the second resistor R2 is connected to an output terminal of the OP amplifier.

The output voltage AVDD of the output terminal of the OP amplifier is shown in Equation 2.

$$AVDD = \left(1 + \frac{R2}{R1}\right) * ELVDD \quad \text{[Equation 2]}$$

The second voltage generator 43 multiplies the first voltage ELVDD by a predetermined number K to generate the second voltage AVDD. Herein, the K value is determined as 1+(R2/R1), and may be adjusted by adjusting the first resistor R1 and the second resistor R2. The resistance values of the first resistor R1 and the second resistor R2 may be adjusted according to the control signal CONT_R of the controller 45.

Embodiment 2

Figure 9:
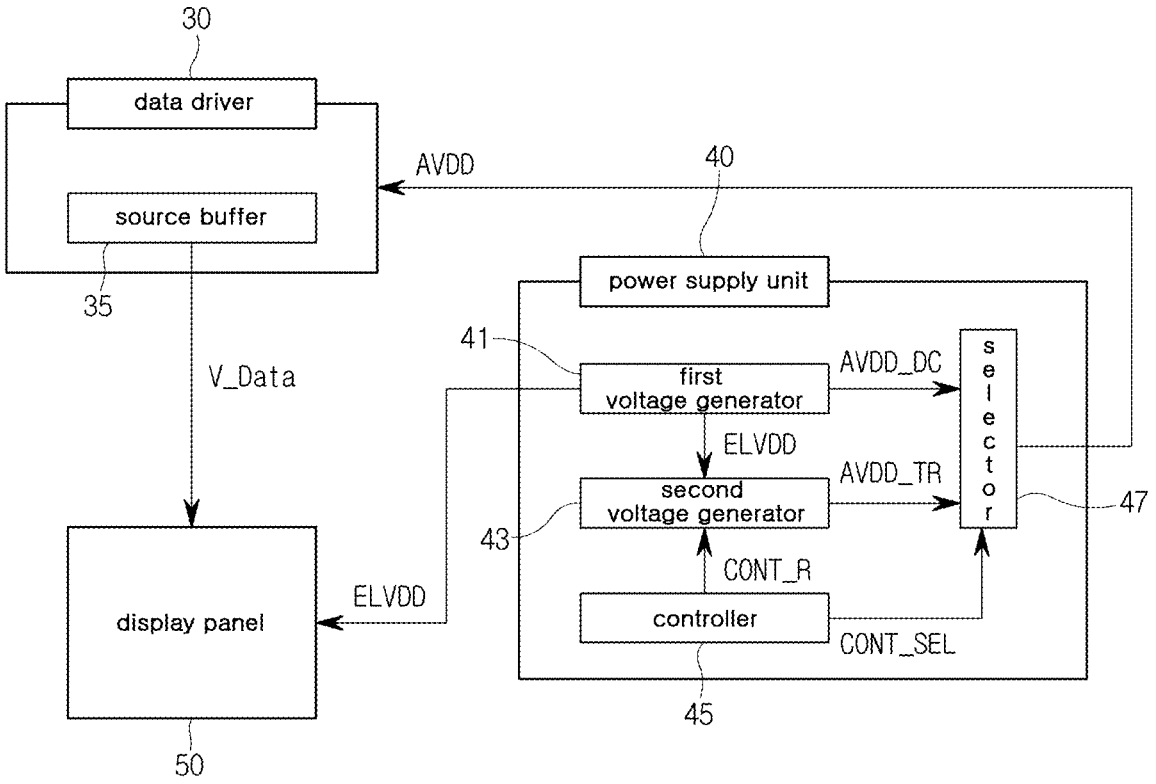
FIG. 9 is a block diagram illustrating a driver for a display device according to a second embodiment of the present disclosure.

FIG. 9 is a block diagram illustrating a driver for a display device according to a second embodiment of the present disclosure.

Figure 10:
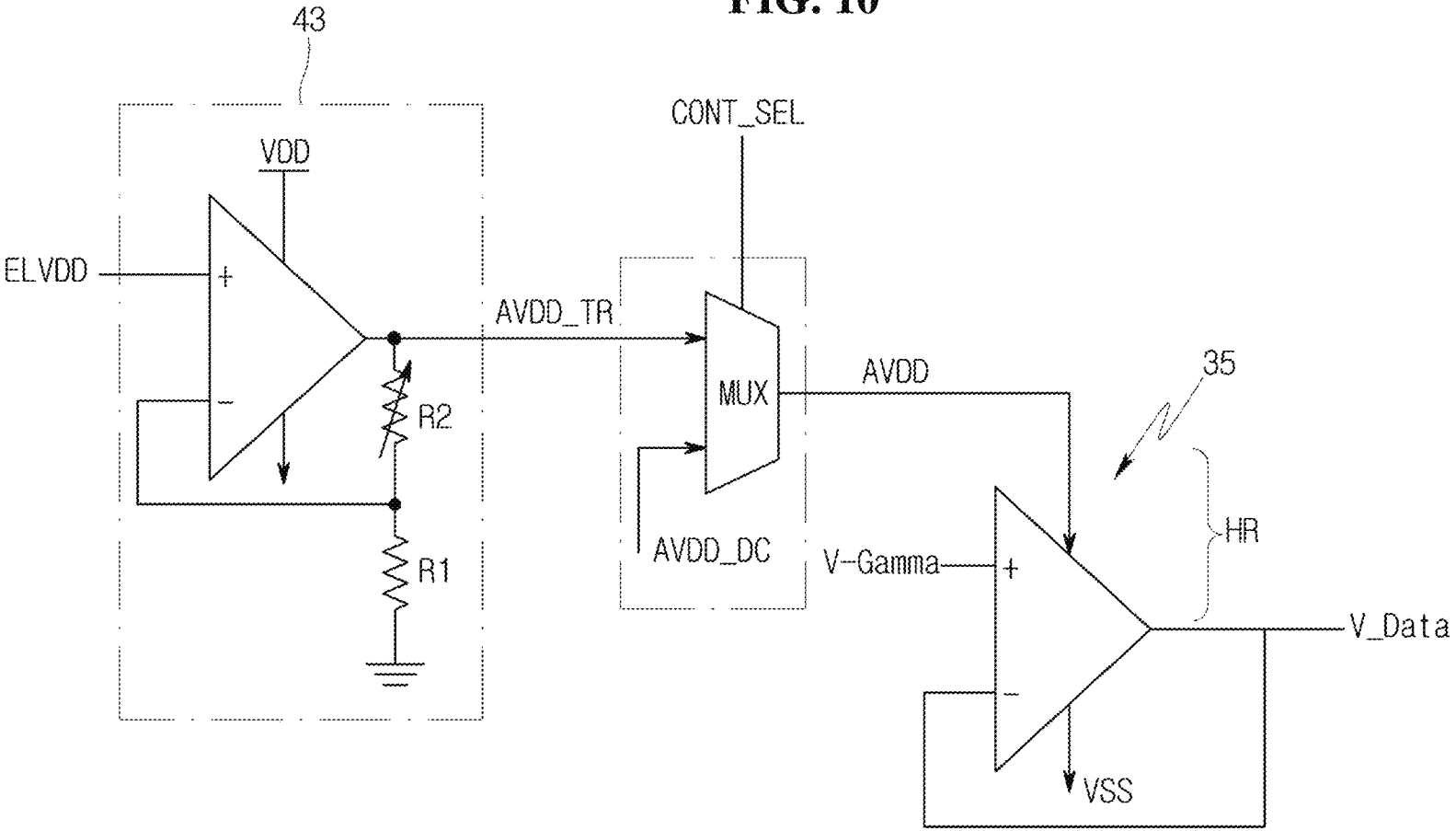
FIG. 10 is a main circuit diagram illustrating a driver for a display device according to a second embodiment of the present disclosure.

FIG. 10 is a main circuit diagram illustrating a driver for a display device according to a second embodiment of the present disclosure.

A driver for a display device according to an embodiment of the present disclosure includes a data driver 30 including a source buffer 35 for outputting a data voltage V_data to a data line of a display panel 50, and a power supply unit 40 that supplies a first voltage ELVDD to a power line of the display panel 50 and supplies a second voltage AVDD to a data driver 30.

The power supply unit 40 includes a first voltage generator 41, a second voltage generator 43, a controller 45, and a selector 47.

The first voltage generator 41 generates the first voltage ELVDD to be supplied to the power line of the display panel 50. In addition, the first voltage generator 41 generates a second voltage AVDD_DC to be supplied to the selector 47. The second voltage AVDD_DC may be a direct current (DC) voltage having a constant value.

The second voltage generator 43 generates a third voltage AVDD_TR on the basis of the first voltage ELVDD, and supplies the third voltage AVDD_TR to the selector 47.

The controller 45 outputs a control signal CONT_R to the second voltage generator 43 to adjust the third voltage AVDD_R generated by the second voltage generator 43. Then, the controller 45 outputs a control signal CONT_SEL to the selector 47.

The selector 47 selects one of the second voltage AVDD_DC or the third voltage AVDD_TR, which are input on the basis of the input control signal CONT_SEL, and outputs the selected one to the data driver 30.

The second voltage generator 43 may multiply the first voltage ELVDD by a predetermined number K to generate the third voltage AVDD_TR. In addition, the second voltage generator 43 may increase the first voltage ELVDD by a predetermined voltage to generate the third voltage AVDD_TR.

The second voltage generator 43 may be configured with a non-inverting amplification circuit including an OP amplifier. The second voltage generator 43 includes an OP amplifier, a first resistor R1, and a second resistor R2. The non-inverting amplification circuit including the OP amplifier is as described with respect to the first embodiment.

The selector 47 may be composed of a 2×1 MUX. The second voltage AVDD_DC output by the first voltage generator and the third voltage AVDD_TR output by the second voltage generator are input to the MUX. The selector 47 selects one of the second voltage AVDD_DC or the third voltage AVDD_TR according to the MUX output selection signal CONT_SEL of the controller and outputs the selected one to the source buffer 35 of the data driver 30.

Figure 11:
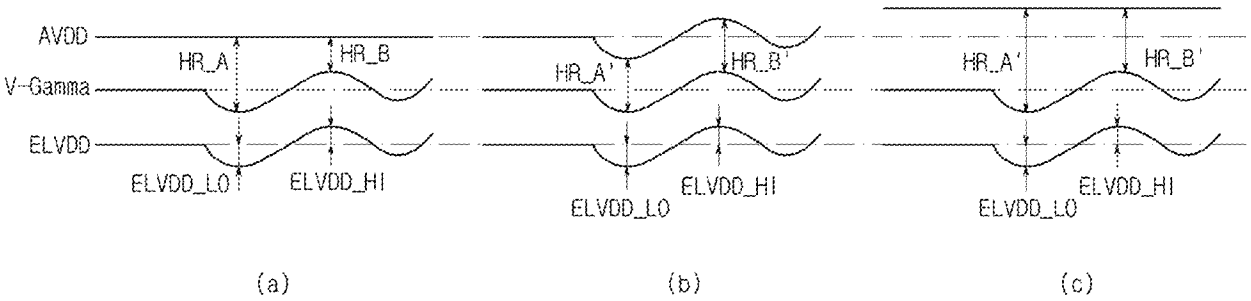
FIG. 11 is a view illustrating improvement of a problem that a headroom HR margin of a source buffer is deficient, according to an embodiment of the present disclosure.

FIG. 11 is a view illustrating improvement of a problem that a headroom HR margin of a source buffer is deficient.

In section (a) of FIG. 11, it shows that a variation in gamma voltage V-Gamma occur due to a variation in the voltage ELVDD, and thus a difference HR_B between a voltage AVDD supplied as a bias voltage of the source buffer and a gamma voltage V-Gamma in a section B is reduced, so that a headroom margin HR is not secured.

In section (b) of FIG. 11, it shows that since the power supply unit according to an embodiment of the present disclosure generates the voltage AVDD on the basis of the voltage ELVDD, so that the voltage AVDD varies in conjunction with ELVDD, a difference HR_B' between the voltage AVDD and the gamma voltage V-Gamma in the section (b) remains almost the same as a difference HR_A' between them in a section (a), whereby the headroom margin is sufficiently secured in all sections.

In section (c) of FIG. 11, it shows another method of securing the headroom margin, in which the power supply unit is not associated with the ELVDD voltage and simply increases the AVDD voltage sufficiently to be output. Since the AVDD voltage is sufficiently increased to be output, it is possible to secure a sufficient headroom margin in the section (b). However, since the AVDD voltage value is always output at a high value, such a method has a disadvantage in that power consumption is high, unlike in the case of section (b) of FIG. 11.

As described above, the driver for a display device according to an embodiment of the present disclosure is characterized in generating an AVDD voltage supplied as a bias voltage of a source buffer of a data driver in conjunction with an ELVDD voltage supplied to a display panel. Therefore, the driver for the display device according to an embodiment has an advantage that the headroom margin of the source buffer can be secured and power consumption of the driver is low at the same time, even when an image data pattern causing a variation in the voltage ELVDD is input to the display device.

It should be understood that the embodiments described above are illustrative in all respects and not restrictive. The scope of the present disclosure is indicated by the following claims rather than the above detailed description, and all changes or modifications derived from the meaning and scope of the claims and equivalent concepts should be interpreted as being included in the claims of the present disclosure.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A driver for a display device, the driver comprising:

a data driver including a source buffer that outputs a data voltage to a data line of a display panel of the display device; and a power supply unit supplying a first voltage to a power line of the display panel and a second voltage to the data driver, wherein the power supply unit includes:

a first voltage generator generating the first voltage; and a second voltage generator generating the second voltage based on the first voltage, in which the second voltage is supplied as a bias voltage of the source buffer, wherein the second voltage generator multiplies the first voltage by a predetermined number to generate the second voltage or increases the first voltage by a predetermined voltage to generate the second voltage.

2. The driver of claim 1, wherein the second voltage generator includes an operational amplifier, a first resistor, and a second resistor, in which the first voltage is applied to a first input terminal of the operational amplifier, a second input terminal of the operational amplifier is connected to one end of the first resistor and one end of the second resistor, another end of the first resistor is grounded, and another end of the second resistor is connected to an output terminal of the operational amplifier.

3. The driver of claim 2, wherein at least one of the first resistor or the second resistor is a variable resistor.

4. The driver of claim 3, wherein the power supply unit further includes a controller for adjusting the variable resistor, wherein the variable resistor is at least one of the first resistor and the second resistor.

* * * * *